US005456755A

United States Patent [19]

Oomori et al.

[11] Patent Number: 5,456,755

[45] Date of Patent: Oct. 10, 1995

[54] FULL AUTOMATIC COATING SYSTEM FOR COATING VARIOUS TYPES OF PRODUCTS PRODUCED IN SMALL QUANTITIES

[75] Inventors: Shigenori Oomori; Hiroshi Yoshida; Yoshimichi Yamakita, all of Toyama, Japan

[73] Assignee: YKK Corporation, Tokyo, Japan

[21] Appl. No.: 315,444

[22] Filed: Sep. 30, 1994

[30] Foreign Application Priority Data

Oct. 5, 1993 [JP] Japan ..... 5-249171

[51] Int. Cl.[6] ..... B05C 5/00

[52] U.S. Cl. ..... 118/704; 118/58; 118/64; 118/66; 118/70; 118/300; 118/324; 118/629; 118/630; 118/712

[58] Field of Search ..... 118/58, 64, 66, 118/70, 300, 324, 326, 629, 630, 632, 642, 704, 712; 427/388.1, 467, 469

[56] References Cited

U.S. PATENT DOCUMENTS

| | | | |
|---|---|---|---|
| 3,601,088 | 8/1971 | Lacam | 118/303 |
| 3,716,022 | 2/1973 | Szczepanski | 118/704 |
| 3,895,126 | 7/1975 | Strauss et al. | 118/66 |
| 4,463,704 | 8/1984 | Farnam | 118/642 |
| 4,656,051 | 4/1987 | Wojcik | 118/632 |
| 5,081,731 | 1/1992 | Yamakita et al. | 68/205 R |

FOREIGN PATENT DOCUMENTS

| | | |
|---|---|---|
| 330333 | 3/1991 | Japan . |
| 357402 | 3/1991 | Japan . |

*Primary Examiner*—W. Gary Jones
*Assistant Examiner*—Laura E. Edwards
*Attorney, Agent, or Firm*—Hill, Steadman & Simpson

[57] ABSTRACT

A full automatic coating system includes an endless metal tape driven to run in one direction along an endless traveling path, a product supplying station for automatically selecting products of a desired type and supplying them to the endless metal tape according to a production control procedure stored in a control unit, a coating station disposed in the traveling path downstream of the product supplying station and including a spray gun for selectively spraying one of coatings of different colors according to instructions received from the control unit, a drying and baking station and a coating removing station disposed in the traveling path downstream of the coating portion in the order named. All the components are linked to operate in timed relation to one another according to the instructions received from the control unit. The coating system thus constructed is compact in size, inexpensive to manufacture, and capable of automatically coating such a small quantity of products which conventionally required manual coating operation.

6 Claims, 8 Drawing Sheets

FULL AUTOMATIC COATING SYSTEM FOR COATING VARIOUS TYPES OF PRODUCTS PRODUCED IN SMALL QUANTITIES

BACKGROUND OF THE INVENTION

1. Field of the Invention

The present invention relates to a full automatic coating system which is capable of coating small quantities of products of various different types and which can be reduced in size.

2. Description of the Prior Art

Various techniques for continuously coating large-sized articles, such as automobile bodies and door panels, have become established. Insofar as the large-sized articles are concerned, the coating cost can be included in the overall price of the individual articles. It is therefore possible to coat or paint individual custom-made products by manual painting operation by a painter. However, for various small-sized components used in automobiles, a continuous coating system constructed to coat individual components one by one is not suitable from the economical point of view. Accordingly, the small-sized components are usually coated in lots.

The circumstances described above with respect to the small-sized components are also applied to the field of slide fasteners. When a slide fastener of a particular type and having a particular color is to be manufactured in great amounts, it is possible to use a continuous production system using a large-sized equipment set in a plant. Japanese Utility Model Publication No. 42-8132, for example, discloses a coating jig for slide fastener sliders. The disclosed jig includes a rectangular frame provided with hooks and having a plurality of slider attachment plates mounted thereon in an arrangement as of sloping fins of a louver. Each of the slider attachment plates has a plurality of regularly spaced slider attachment portions. A number of sliders are attached to the slider attachment portions of all of the slider attachment plates, and front and rear sides of the respective sliders are coated while the hooks of the coating jig are properly supported. By using the coating jig together with a coating apparatus or system in the plant, a large quantity of components (sliders) can be continuously coated.

In recent years the tastes of general consumers have varied widely, and a decorative demand has increased even against notions used not only on garments but also on bags. Such a decorative demand has also extended to the field of slide fasteners, and it has become increasingly difficult to meet the color requirements regarding all the slide fasteners to be manufactured, only by means of the existing colors. There is an extreme instance where a very small quantity (20 to 40 pieces) of slide fasteners having a special color should be manufactured. To meet such extreme demand, the manufacturer must rely upon manual operation of workers highly skilled in dyeing and painting techniques. The thus produced slide fasteners are too expensive to use as accessories.

To meet the economical point of view without relying upon the laborious manual operation, a single type of product must be mass-produced. However, when producing various types of products, the mass-production system necessarily involves large quantities of stocks which require a complicated stock control system. In this instance, if the various types of products are all new products, the delivery time limits for the respective products will greatly be extended.

SUMMARY OF THE INVENTION

With the foregoing difficulties in view, it is an object of the present invention to provide a full automatic coating system which is compact in size, economical to manufacture and capable of mechanically and automatically coating various types of products even when the products are new products and produced in small quantities which require a manual coating operation conventionally.

In developing such a full automatic coating system, it may be noted that uncoated products of a desired type must be reliably and speedily supplied to and discharged from a coating station and a drying and baking station, and a coating or paint of a desired color must be prepared and supplied to the coating station in timed relation to the supply of the uncoated products. It is natural in the coating engineering that environmental conditions of the coating site and appropriate measures against sanitary and pollution problems should be considered.

As a highly adaptable, full automatic coating system, it is required that the equipment cost and the necessary installation space should be reduced to such an extent as to enable installation in a small space and to provide a reasonable cost. In the coating system, the drying and baking station provided downstream of the coating station requires the largest room or space. Accordingly, a reduction in size of the drying (baking) station directly leads to a reduction of the overall size of the coating system.

According to the present invention, all of the foregoing conditions which are required for providing an automatic coating system readily adaptable to the multi-type small-quantity production system have been considered thoroughly, and based on the thorough consideration, a full automatic coating system capable of satisfactorily meeting all of the necessary conditions has been developed.

The full automatic coating system of the invention for coating small quantities of products of various different types, comprises: at least one endless, product conveying means running in one direction along an endless traveling path; a product supplying station disposed adjacent to a portion of the traveling path for supplying uncoated products to the product conveying means; a coating station disposed in the traveling path downstream of the product supplying station for coating the uncoated products; a drying and baking station disposed in the traveling path downstream of the coating station and including drying and baking means for drying and baking coated products, and coated product discharging means for discharging the coated products from the drying and baking station; a coating removing station disposed in the traveling path downstream of the drying and baking station for removing a coating from the product conveying means; a control unit for controlling the operation and timing of the conveying means, the product supplying station, the coating station, the drying and and baking station, and the coating removing station; automatic product selecting means for selecting out a predetermined quantity of uncoated products of a predetermined type from among the various different types of products according to a production control procedure stored in the control unit; and automatic mixing and thinning apparatus for selecting out at least one coating of a predetermined color from among a multiplicity of base coatings of different colors, and for automatically weighing, mixing, if necessary, and thinning the selected coating according to the production control procedure stored in the control unit. The product supplying station includes automatic supplying means operatively connected with the automatic product selecting means for supplying the predetermined quantity of uncoated products of the predetermined type to the product conveying means while successively aligning the uncoated products. The coating station is composed of a closed coating chamber and includes coating means for coating the uncoated products with the selected coating, and mist removing means for removing a mist from the closed coating chamber.

The drying and baking station is preferably composed of a closed heating chamber having an inlet and an outlet for the passage therethrough of the product conveying means and includes product removing means disposed adjacent to the outlet for removing the coated products from the product conveying means while the product conveying means is running, and at least one stage of removed product transfer means for receiving the coated products removed from the product conveying means and thereafter conveying the thus received coated products in the opposite direction. The product conveying means preferably is an endless metal tape.

The number of the coating means is at least one and this at least one coating means includes a coating changeover circuit and a cleaning fluid changeover circuit. The removed product transfer means preferably comprises a porous endless belt. According to a preferred embodiment, an inclined chute extends between the product removing means and the removed product transfer means.

In operation, according to the instructions received from the control station, a predetermined quantity of uncoated products of a desired type are supplied one after another at regular intervals from the product supplying station onto the product conveying means running in one direction along an endless traveling path. The uncoated products supplied to the product conveying means are then introduced into the coating station. In the coating station, a coating is provided on the surface of each product. In a setting station disposed immediately downstream of the coating station, a solvent remaining in the coating on the surface of the product and on the surface of the tape-like conveying means is removed by vaporization to stably set the coating. Coated products which have left from the setting station subsequently move into the drying and baking station held in a closed condition.

In a preferred embodiment, the coated products carried on the product conveying means are pre-dried in the drying and baking station while the product conveying means is running within the drying and baking station. The product removing means, which is disposed in the vicinity of an outlet of the drying and baking station, removes the coated products from the product conveying means and allows them to fall onto a conveying surface of the removed product transfer means which is disposed at a lower portion of the drying and baking station and running in a direction opposite to the direction of movement of the product conveying means. The coated products carried on the removed product transfer means are then conveyed in the reverse direction within the drying and baking station during which time the coating on the surface of each coated product is baked to form a tough, durable coating film. By providing at least one stage of such removed product transfer means extending below the product conveying means, it is possible to maintain a sufficient baking time even when the drying and baking station is half the length of a conventional drying and baking station. The bake-finished products are discharged from the drying and baking station by the coated product discharging means.

After the coated products have been removed, the product conveying means further continues its movement in one direction and then enters the coating removing station where the coating is removed from the front and back surfaces of the product conveying means by a coating removing means such as a pair of rotating brushes. In this instance, since the product conveying means has passed through the drying and baking station in a shorter period of time than as required for a complete baking operation, the coating on the product conveying means has not been baked completely so that it can be readily removed by brushing, for example, using a simple removing means such as rotary brushes.

An electrostatic spraying device used as the coating means of the coating station is able to apply a coating uniformly over the entire surface of the product. When a wire mesh endless conveyor belt is used as the removed product transfer means disposed in the drying and baking station, the efficiency of the drying and baking operation is particularly high.

When a predetermined quantity of products (slide fastener sliders, for example) of the predetermined type have been coated, new instructions are issued from the control unit according to data, such as the type and quantity of sliders to be coated in the next coating operation and a coating to be used in the next coating operation, and a product arresting device and a product changeover device both provided in the product supplying station are activated. At the same time, necessary coating pipings provided in the coating station are changed over while adjusting the spraying pressure of the predetermined coating.

When the next coating operation is started, a product guide channel in the product arresting devices is opened whereupon uncoated sliders arranged in the same posture or orientation are allowed to fall by gravity down along the product guide channel. The number of falling sliders is counted by the product changeover means and when the counted number is equal to a preset value, the product guide channel in the product arresting device is closed to stop downward movement of the sliders. At the same time, according to control signals sent at predetermined time intervals from the control unit, a delivery speed controlling means is intermittently driven to deliver the sliders at predetermined intervals from the product guide channel to the product conveying means.

In the coating station, a coating container holding therein a coating or paint of a different color is set in a predetermined position and connected to a corresponding force feed means before the type of products is changed over in the product supplying station. When the preceding coating operation completes, a coating changeover valve disposed within the coating means closes the coating piping used in the preceding cycle, and a cleaning fluid changeover valve is opened to cleaning up a discharge hole of the coating means. When the coating means is cleaned up, a coating piping to be used in the next coating operation is opened and a new coating or paint is forced out by the force feed means and flows through the opened coating piping toward the coating means during which time the discharge pressure of the coating is regulated. The pressure-regulated coating is finally sprayed from the coating means toward the uncoated products, i.e., sliders.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
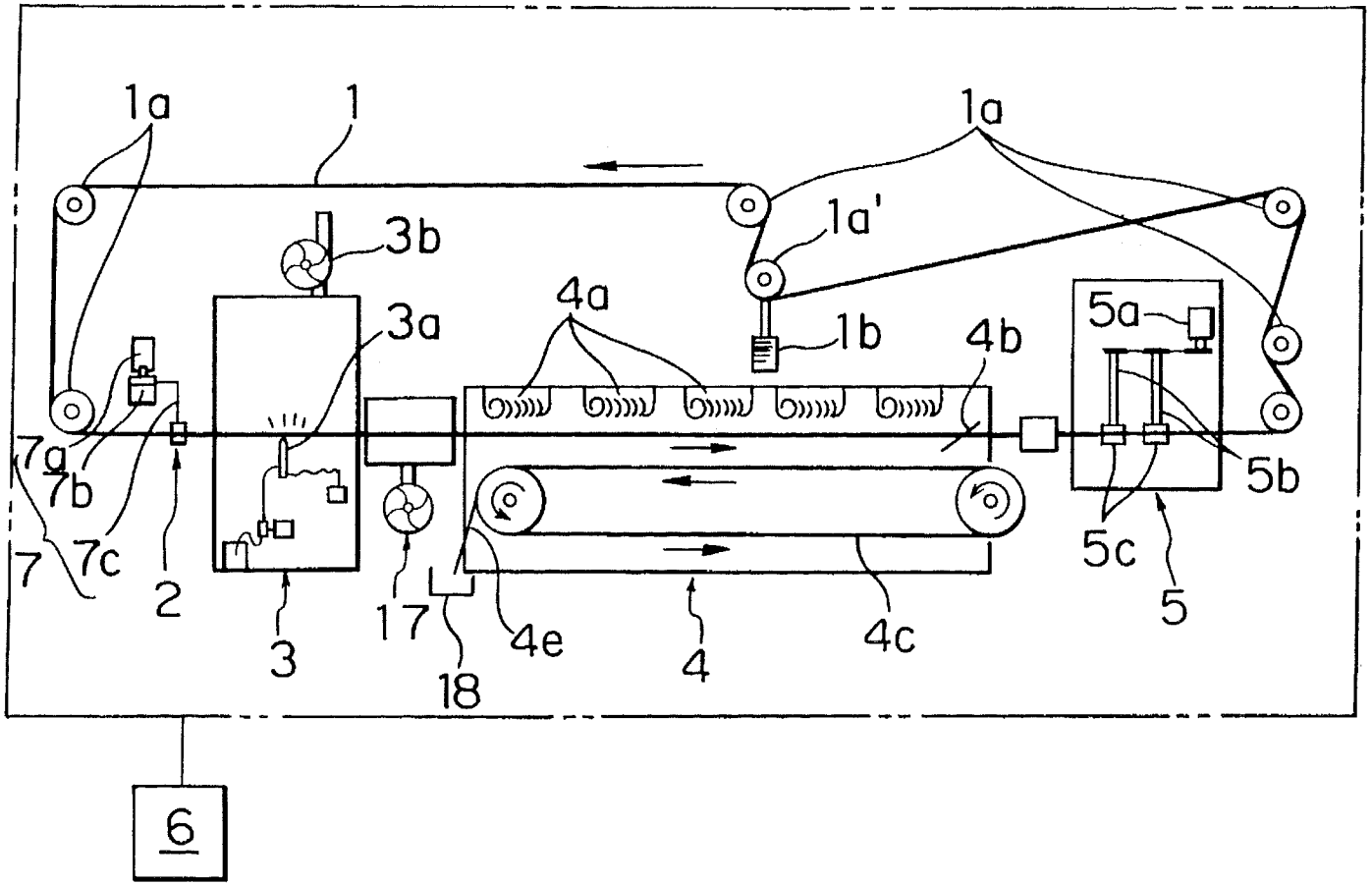
FIG. 1 is a diagrammatical side view showing the general construction of a continuous coating system used for coating slide fastener sliders according to the present invention.

Referring now to the drawings, wherein like reference characters designate like or corresponding parts throughout the several views, there is shown in FIG. 1 the general construction of a full automatic coating system of the present invention embodied as a slider coating machine for coating slide fastener sliders.

The slider coating machine generally comprises an endless metal tape 1 running in one direction along an endless traveling path, a slider supplying station 2 disposed adjacent to a portion of the traveling path for supplying uncoated sliders 10 to the endless metal tape 1, a continuous coating station 3 disposed in the traveling path downstream of the slider supplying station 2, a drying and baking station 4 disposed in the traveling path downstream of the coating station 3 and including a drying and baking means 4*a* for drying and baking coated sliders 11 and a discharging means 4*e* for discharging the coated sliders 11, a coating removing station 5 disposed in the traveling path downstream of the drying and baking station 4 for removing a coating from a surface of the metal tape 1, and a control unit 6 for controlling the operation and timing of the foregoing components 1–5. The term "uncoated sliders" or "uncoated products" is used herein to refer to those sliders or products which are free from a coating layer or coated with an undercoat layer.

The endless metal tape 1 is wound around a group of rollers la including a drive roller and is driven to run in one direction along the endless traveling path. One of the rollers la which is designated by 1*a*' serves as a tension roller. To this end, the tension roller 1*a*' is urged by a spring 1*b* in a direction to stretch or tension the metal tape 1 with a uniform tensioning force. At least a portion of the full length of the running metal tape 1 which carries thereon the uncoated sliders 10 is held in a laterally tilted posture shown in FIG. 4 for a reason described below. Owing to the laterally tilted posture, the metal tape 1 can be used as a slider conveying means or conveyor as in the illustrated embodiment. If the slider conveying means were running with its wing support surfaces lying vertically, the uncoated slider 10 would be held with its pull tab 10*c* lying flat on an upper wing 10*a* of the slider 10. With the slider pull tab 10*c* thus arranged, uniform coating could not be achieved in the subsequent coating process. Conversely, the metal tape 1 constituting the slider conveying means of the present invention is laterally tilted toward the pull tab 10*c* side of the uncoated sliders 10 supported on and along an upper edge of the metal tape 1. With this laterally tilted posture of the metal tape 1, the pull tab 10*c* of each of the uncoated sliders 10 is separated or spaced from the front surface of the upper wing 10*a*. The thus spaced pull tab 10*c* makes it possible to uniformly coat the slider 10 without damaging a coated surface of the slider 10. The laterally tilted arrangement of the metal tape 1 is always effective when used with articles or products which have a pivotable part such as a pull tab 10*c* and have a center of gravity displaced off center from the supported point of the articles or products.

The product conveying means of the present invention may be modified into an adequate form according to the structure of a product to be coated. For example, a wire or a chain having a number of regularly spaced hooks may be used as a product conveying means.

Figure 2:
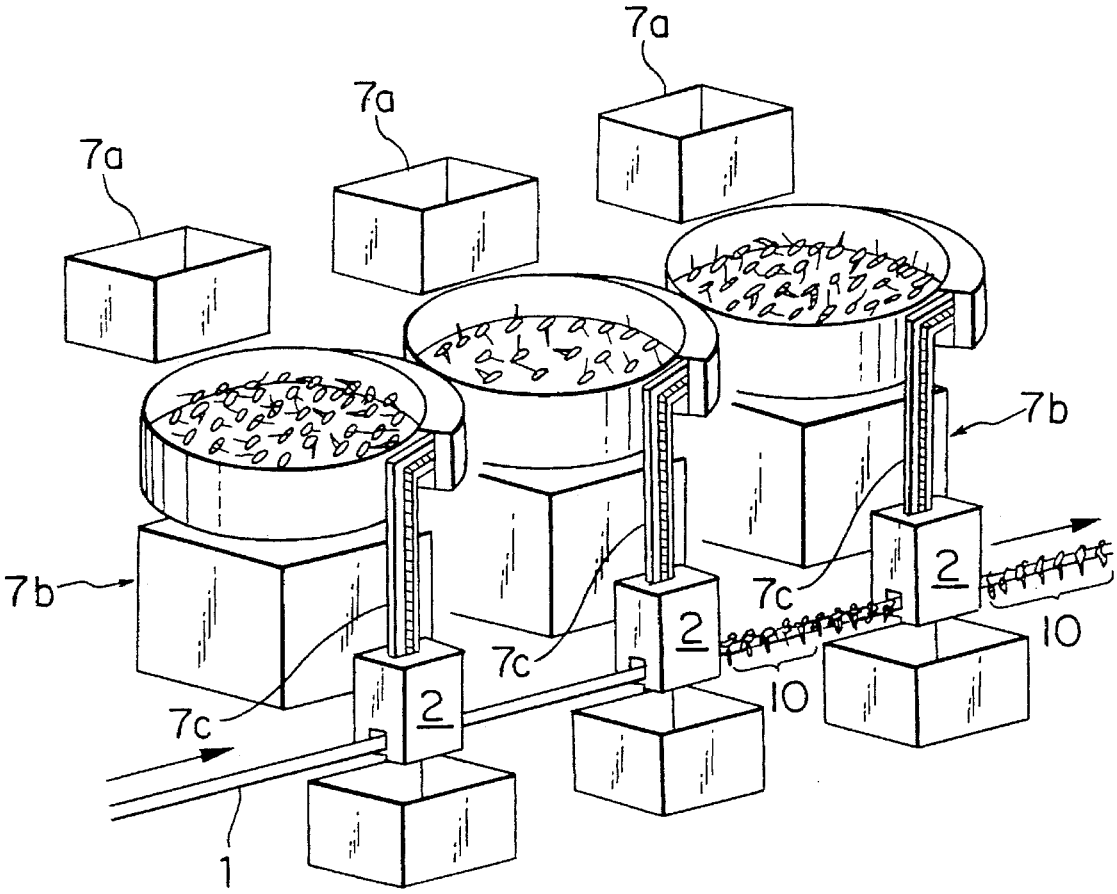
FIG. 2 is a perspective view showing the general construction of a product supplying station for supplying uncoated product according to the present invention.

As shown in FIG. 2, the slider supplying station 2 is connected with a product selecting and supplying means 7 which serves to select out a desired type of products (sliders) from among various types of products (sliders) and supply a predetermined quantity of the selected products (sliders) of the desired type to the slider supplying station 2. The slider supplying station 2 includes an automatic changeover delivery means 2*a*, 2*b* (FIG. 3) for delivering the uncoated sliders 10 of the type selected by and supplied from the product selecting and supplying means 7, to the metal tape 1 while successively aligning the uncoated sliders 10 according to a production control procedure stored in the control unit 6. The product selecting and supplying means 7 comprises, as shown in FIG. 2, a plurality of containers or cases 7*a* each holding therein one of different types of uncoated sliders, and a corresponding number of parts feeders 7*b* disposed below the corresponding cases 7*a* to receive the uncoated sliders 10 respectively from the cases 7*a*. The parts feeders 7*b* may be of the construction known per se and each have an electromagnetic vibrator such as disclosed, for example, in Japanese Utility Model Publication 3-30333. The parts feeder 7*b* feeds uncoated sliders 10 in succession from a non-illustrated feed track onto a chute rail 7*c* while arranging them in a uniform posture.

Figure 3:
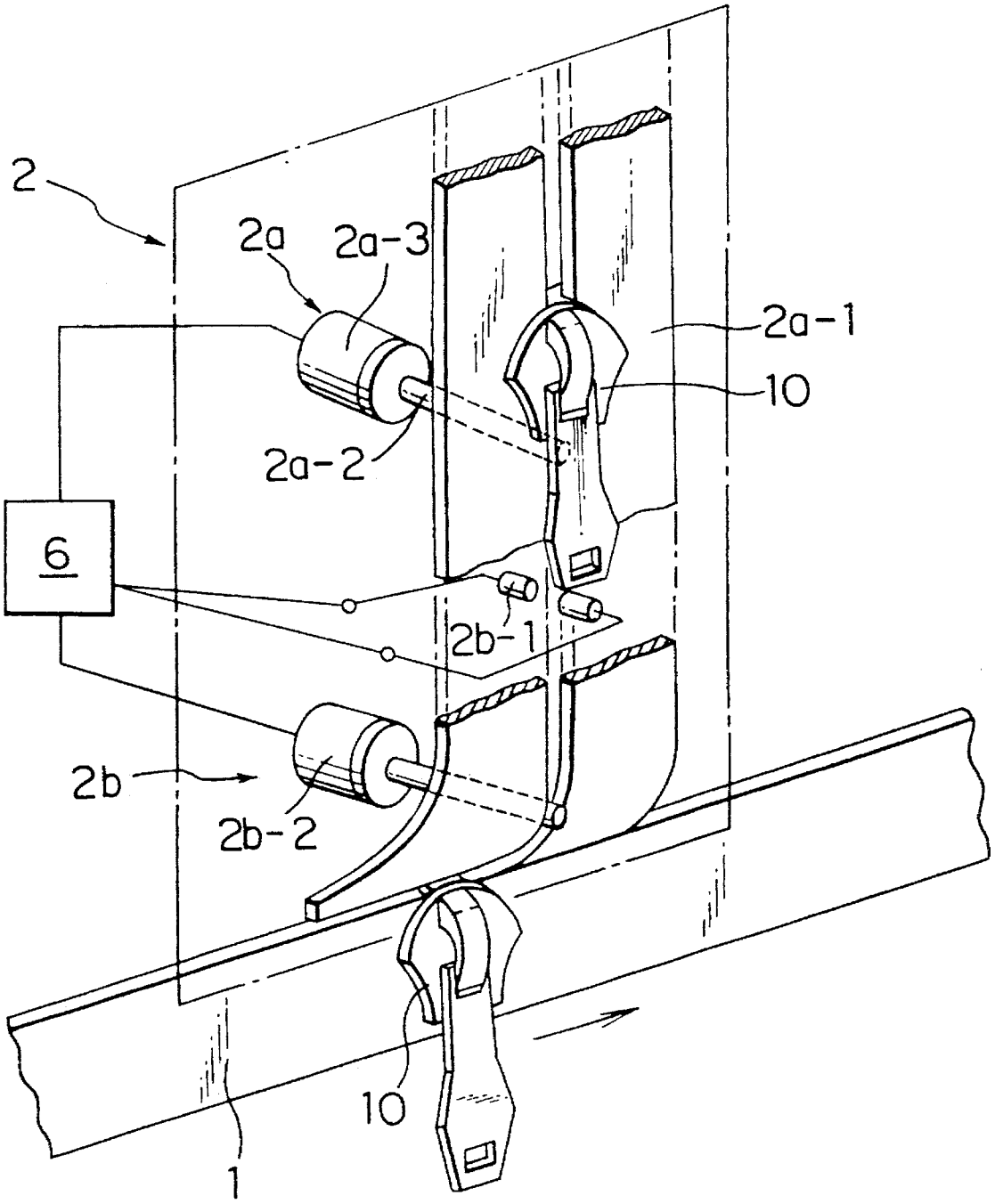
FIG. 3 is a perspective view showing a main portion of a product supplying means disposed in the product supplying station.

As shown in FIG. 3, the automatic changeover delivery means 2*a*, 2*b* of the product supplying station 2 is composed of a slider arresting device 2*a* which arrest the downward movement of the uncoated sliders 10 to hold them in a uniform standby posture while the sliders 10 are guided on and along the chute rail 7*c* of the corresponding parts feeder 7*b*, and a slider changeover device 2*b* which releases the standby condition of the arresting device 2*a* to slidably deliver a predetermined number of uncoated sliders 10 to the metal tape 1. The arresting device 2*a* includes a guide rail 2*a*-1 extending contiguously and downwardly from a lower end of the chute rail 7*c* and having a curved lower end portion gently sloping toward the upper edge of the metal tape 1, and a stopper 2a-2 composed of a pin movable into and out of a slider guide channel defined longitudinally in the guide rail 2a-1. The stopper 2a-2 is reciprocated by a fluid-pressure actuator 2a-3, such as an air cylinder. The guide rail 2a-1 has substantially the same construction as the chute rail 7c except the curved lower end portion. The sliding speed of the uncoated sliders 10 is slowed down as the uncoated sliders 10 move from the vertically arranged chute rail 7c to the gently sloped lower end portion.

The slider changeover device 2b is connected with the control unit 6a and includes a slider detector 2b-1 disposed below the stopper 2a-2 at a position adjacent to the slider guide channel in the guide rail 2a-1 so as to detect the uncoated sliders 10. The number of uncoated sliders 10 detected by the slider detector 2b-1 is counted in the control unit 6 and when the count is equal to a predetermined number, the control unit 6 sends a signal to the fluid-pressure actuator 2a-3 to activate the same to advance the stopper 2a-2 into the slider guide channel. The changeover device 2b further includes a delivery speed control device 2b-2 disposed downstream of the slider detector 2b-1 to control the delivery speed of the uncoated sliders 10 while the uncoated sliders 10 are delivered to the metal tape 1. As shown in FIG. 3, the delivery speed control device 2b-2 has the same construction as the stopper 2a-1 and is intermittently driven by an electromagnetic driving means according to .signals supplied at predetermined time intervals from a timer (not shown) disposed in the control unit 6 until the delivery speed control device 2b-2 completes a predetermined number of reciprocations relative to the slider guide channel.

The slider changeover device 2b in the illustrated embodiment may be replaced by a slider supplying device disclosed, for example, in Japanese Patent Laid-open Publication No. 3-57402. In the disclosed slider supplying device, various types of sliders which are delivered from the corresponding parts feeders to the associated chute rails are temporarily arrested at the front end portions of the respective chute rails. A slider gripper reciprocatory movable transversely across the chute rails is displaced until it arrives at a desired chute rail. Upon arrival at the desired chute rail, the slider gripper is activated to grip one slider at a time and then transfer the gripped slider from the chute rail to a predetermined position (a delivery position relative to the metal tape 1 according to the present invention). The operation of the parts feeders and the operation of the slider gripper are controlled according to the instructions supplied from the control unit. The slider gripper has a so-called "hand robot mechanism" known per se. For a further description of the configuration and operation of the slider supplying device, reference may be made to the aforesaid Japanese Patent Laid-open Publication No. 3-57402.

Figure 4:
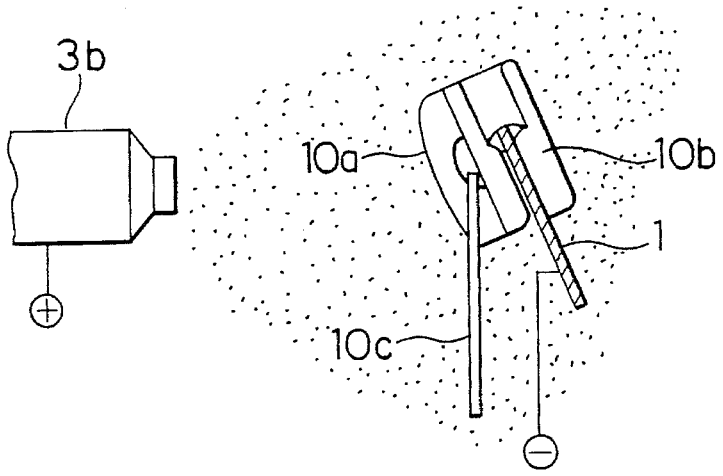
FIG. 4 is a front elevational view, partly in cross section, of a main portion of a coating chamber showing a slide fastener slider being coated.

The uncoated sliders 10 thus delivered onto the upper edge of the metal tape 1 have a posture such that the upper wing 10a and a lower wing 10b of each slider 10 grip the upper edge of the laterally tilted metal tape 1, with the slider pull tab 10c hanging vertically, as shown in FIG. 4.

The coating station 3 is composed of a closed coating chamber having an inlet and an outlet for the passage therethrough of the metal tape 1, and a pair of flexible sealing members provided at the inlet and outlet, respectively, to close them. In the illustrated embodiment, an electrostatic spray gun 3a is disposed in the coating chamber for spraying a coating or paint having a predetermined color onto the uncoated sliders 10 as the uncoated sliders 10 are moved through the coating chamber by the metal tape 1, as shown in FIGS. 1 and 4. The coating chamber also has an exhaust blower 3b provided at a ceiling for exhausting a mist, such as a fine spray of coating or a vaporized solvent, floating in the coating chamber. Though not shown, a floor of the coating chamber is covered with a floor mat for adsorbing the sprayed coating. The coating station 3 is further provided with a plurality of storage containers 8a disposed outside the coating chamber for storing therein base coatings or paints having different colors, and an automatic mixing and thinning apparatus 8 for selecting out one or more base coatings of predetermined colors and automatically weighing, mixing, and thinning the selected base coatings according to the production control procedure previously stored in the control unit 6.

In the illustrated embodiment, an electrostatic spraying system is employed as described above, in which the electrostatic spray gun 3a is connected to the positive terminal of a high-voltage circuit while the metal tape 1 is connected to the opposite or negative terminal of the same high-voltage circuit, as shown in FIG. 4. The polarity of the spray gun 3a and the metal tape 1 may be reversed. The electrostatic spraying system is employed for a reason that the slider 10 has a complicated configuration, and due to a space between the upper wing 10a and the pull tab 10c of the slider 10, the general spray coating method is unable to provide a sufficient amount of coating on the backside of the slider 10 and hence coats the slider 10 irregularly. Obviously, the general spray coating method may be employed when products to be sprayed have a simple construction. The spray gun 3a is connected to a plurality of pipings (see FIG. 7). The spray gun 3a has a changeover valve (not shown) which is automatically changed over in a manner described later according to the production control procedure stored in the control unit 6.

Figure 5:
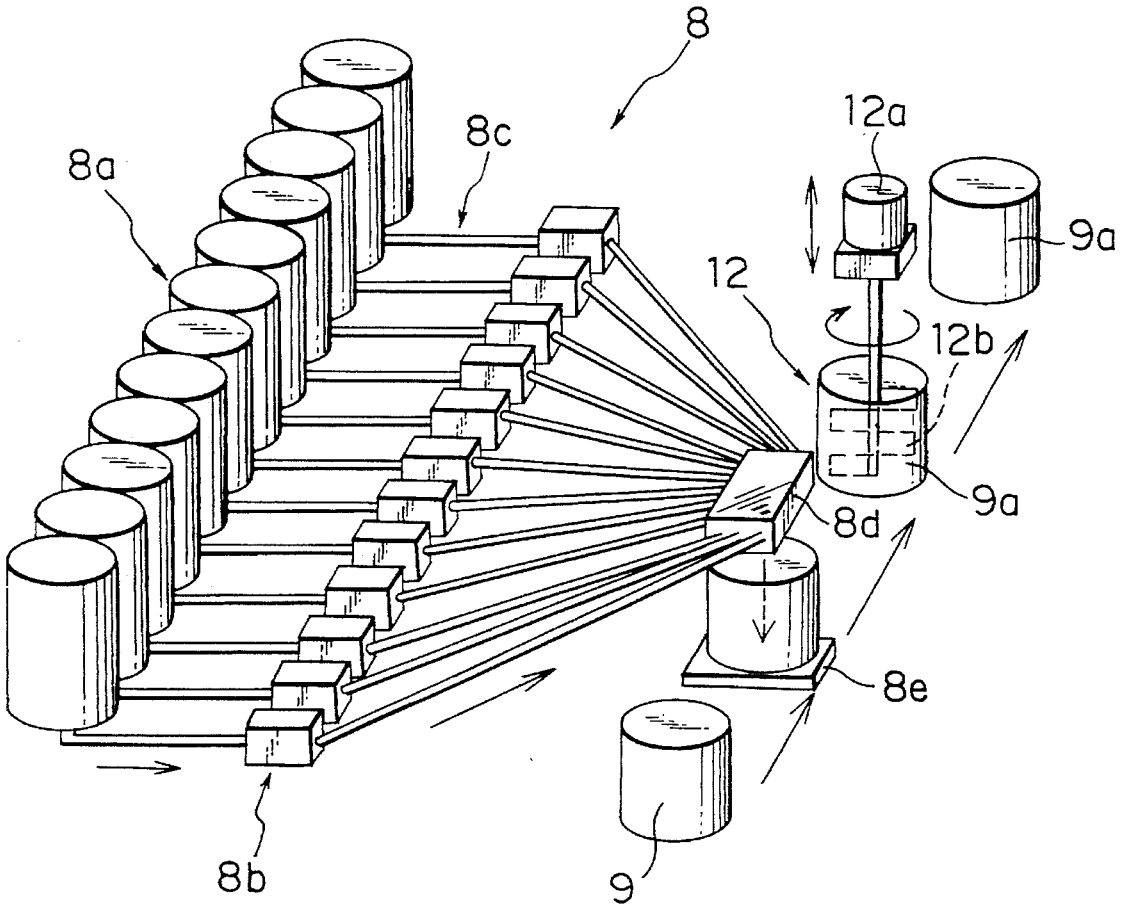
FIG. 5 is a schematic perspective view of a mixing and thinning apparatus provided in a coating station for mixing and thinning base coatings.

The automatic mixing and thinning apparatus 8, as shown in FIG. 5, is composed of a plurality of base coating storage containers 8a, a corresponding number of gear pumps 8b and a corresponding number of pipings 8c connecting the storage containers 8a via the corresponding gear pumps 8b to a discharge portion 8d. The discharge portion 8d includes a plurality of changeover valves (not shown) each connected to a discharge end portion of each of the pipings 8c gathering in converging manner at the discharge portion 8d, and a funnel-shaped hopper (not shown) disposed immediately below the discharge end portions of the respective pipings 8c. Disposed below the discharge portion 8d is a known electronic weighing device 8e for measuring the weight of a coating supplied via a selected one of the changeover valves. The gear pumps 8b and the changeover valves operate such that based on a weighing signal supplied from the electronic weighing device 8e, the changeover valves are switched over in succession according to the control procedure stored in the control unit 6, so as to open the necessary pipings 8c and simultaneously drive the associated gear pumps 8b, thereby feeding out desired base coatings in succession from the corresponding base coating storage containers 8a to the discharge portions 8d. When the amount of each of the desired base coatings reaches fed to the discharge portion 8d reaches to a desired value, a corresponding one of the changeover valves is closed and the corresponding gear pump 8b is stopped.

The electronic weighing device 8e carries thereon an empty coating container 9 which has been placed either by manual operation or by a suitable transporting means. When desired amounts of base coatings to be mixed are received in the coating container 9, the coating container 9 is transferred to a coating mixture stirring device 12 disposed between the electronic weighing device 8e and the coating station 3. The coating mixture stirring device 12 includes a stirring blade 12*b* rotatably driven by an electric motor 12*a*. The stirring blade 12*b* which has previously been cleaned is held in a standby position, and when the coating container 9*a* holding therein a mixture of base coatings is introduced into the coating mixture stirring device 12, the stirring blade 12*b* is inserted into the coating mixture container 9*a* and stirs the mixture of base coatings to homogeneously mixing the base coatings. At the same time, a necessary amount of thinner is supplied from a thinner container (not shown) into the base coating mixture to adjust the viscosity of a mixed coating.

When the stirring process completes, a non-illustrated drive means lifts up the stirring blade 12*b* together with the electric motor 12*a* to remove the stirring blade 12*b* from the coating container 9*a* in which a homogeneously mixed coating is received. Then, the coating container 9*a* is set in a predetermined position within the coating chamber. When environmental working conditions and a pollution problem are taken into consideration, the coating container 9*a* is preferably a closed container having a lid. A small plastic container is particularly advantageous in view of the easiness of aftertreatment.

Figure 6:
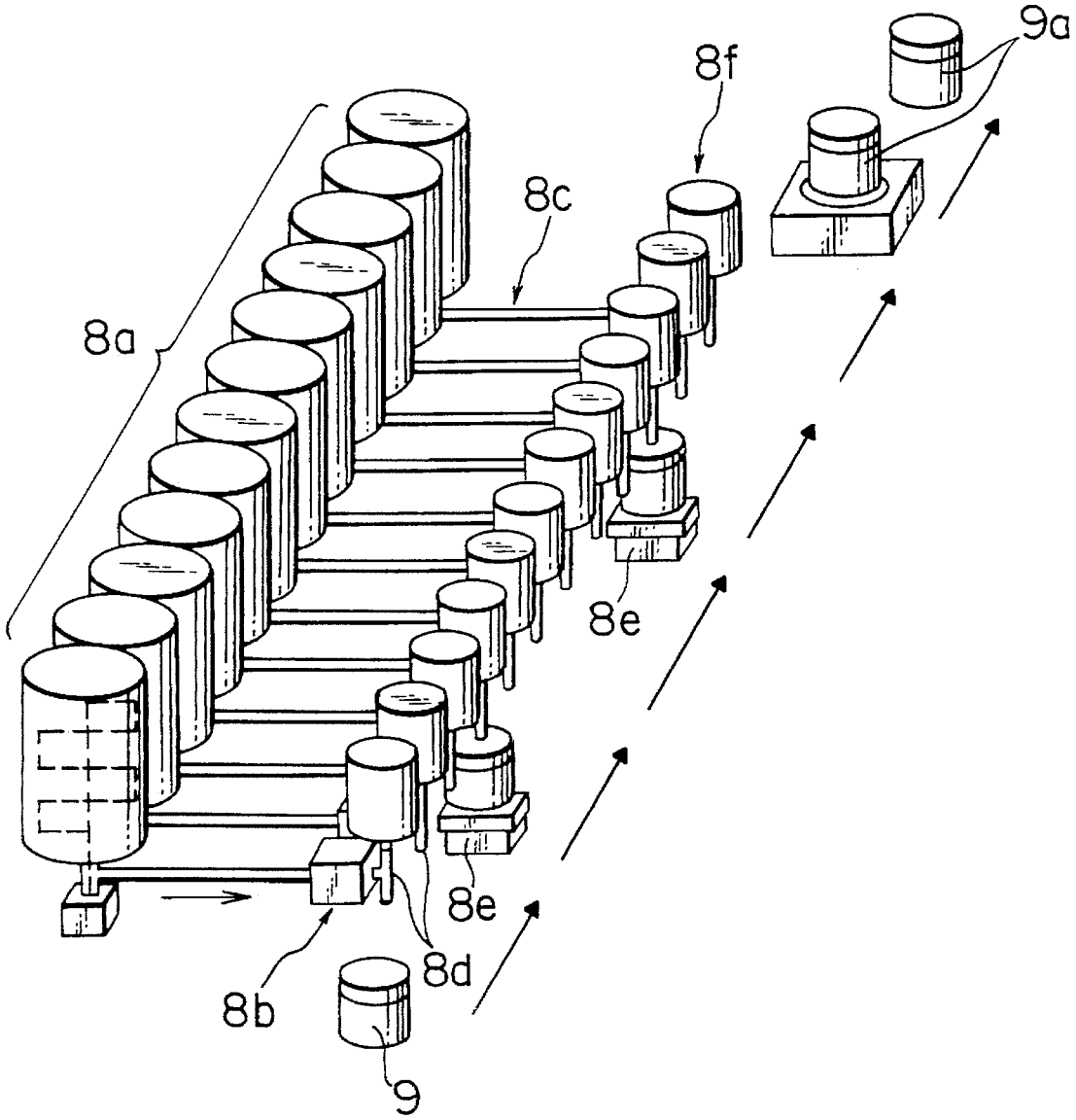
FIG. 6 is a schematic perspective view showing another mixing and thinning apparatus for base coatings which is provided in the coating station.

FIG. 6 shows another embodiment of the automatic mixing and thinning device of the present invention. The same embodiment is described below with reference to the FIG. 6. The modified powdered dye weighing and collecting technique includes, as shown in FIG. 6, a plurality of base coating storage containers 8*a* connected to a plurality of gear pumps 8*b*, respectively, by a plurality of pipings 8*c*. A discharge portion 8*d* of each of the pipings 8*c* is connected to an outlet at the bottom of a corresponding one of a plurality of thinned coating containers 8*f* each containing therein a thinned coating of the same color as the corresponding base coating. The discharge portion 8*d* of each piping 8*c* and the outlet of each thinned coating container 8*f* have a pair of changeover valves (not shown), respectively, that are separately driven under the control of the instructions received from the control unit 6. In the illustrated embodiment, a plurality of electronic weighing devices 8*e* each carrying thereon one coating Container 9*a* are transferred longitudinally along a pair of parallel spaced rails (not shown) while they are positioned or indexed below the respective thinned coating containers 8*f*. Thus, the embodiment shown in FIG. 6 is completely different from the embodiment shown in FIG. 5 in that each of the electronic weighing devices 8*e* is controlled to move successively below the necessary ones of the thinned coating containers 8*f*.

Figure 7:
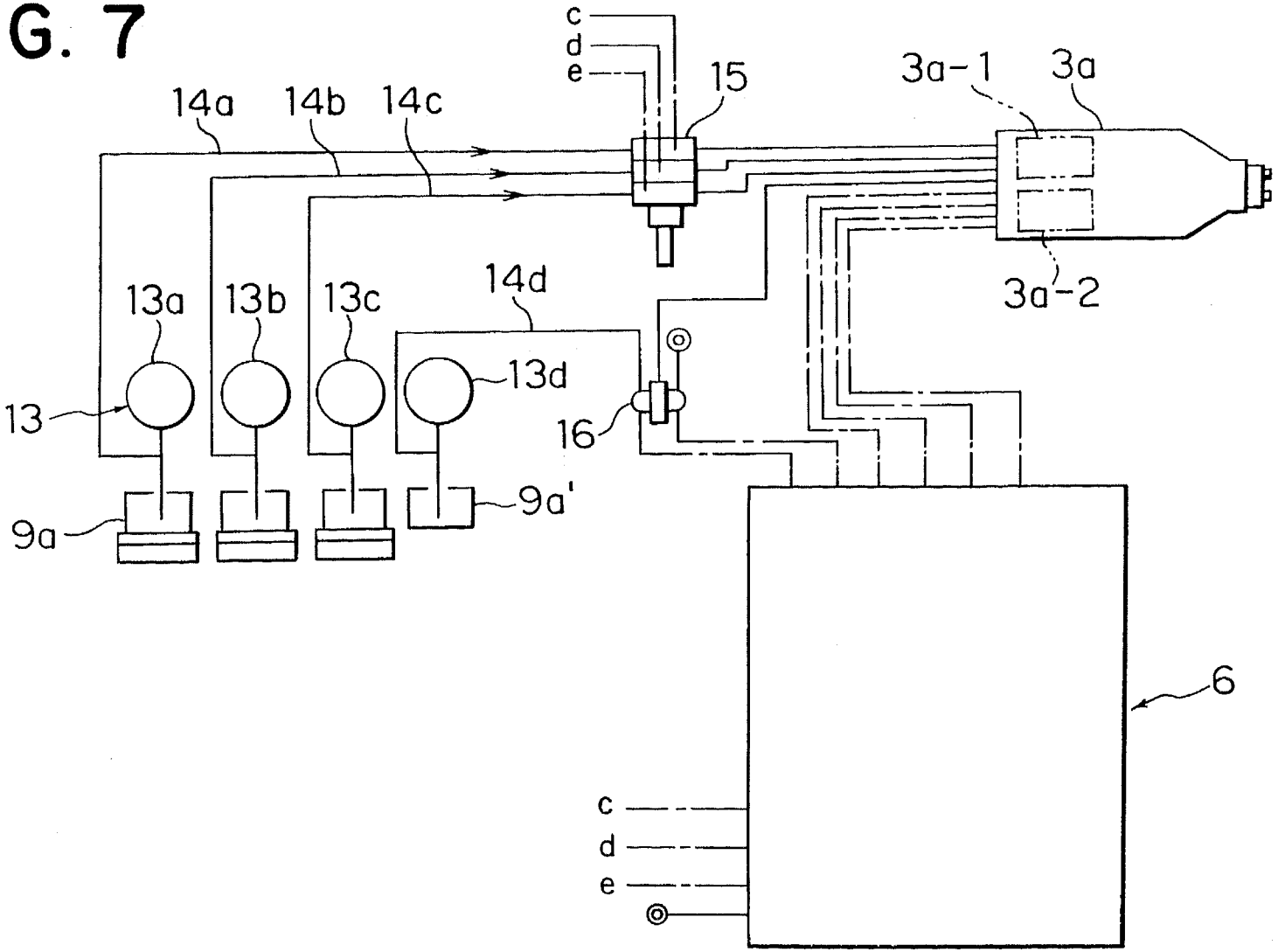
FIG. 7 is a diagrammatical view showing an example of coating changeover circuit of the coating station.

The coating container 9*a* holding therein a mixed coating is transferred to a predetermined position on the outside of the coating chamber and connected to a force feed pump disposed at the same predetermined position. In this instance, a used container is removed from the force feed pump and then fed into an after-treatment process with its open upper end closed by a lid. FIG. 7 is a diagrammatical circuit diagram showing an example of automatic coating changeover mechanism. A plurality of coating containers 9*a* (three in the illustrated embodiment) holding therein coatings of different colors, and a cleaning fluid container 9*a*' are respectively set on a corresponding number of force feed pumps 13*a*, 13*b*, 13*c* and 13*d* (four in the illustrated embodiment). The force feed pumps 13*a*, 13*b*, 13*c* are connected via corresponding pipings 14*a*, 14*b*, 14*c* to the spray gun 3*a* of the coating station 3. Each of the pipings 14*a*–14*c* has a pressure control valve 15 and connected to a corresponding one of a plurality of coating changeover valves (not shown) disposed in a coating changeover circuit 3*a*-1 contained in the spray gun 3*a*. The pressure control valves 15 and the coating changeover valves are controlled by signal supplied from the control unit 6 according to the production control procedure stored in the control unit 6, so as to regulate the discharge pressure of the respective coatings and to changeover the desired pipings 14*a*–14*c*. The piping 14*d* connected to the force feed pump 13*d* for the cleaning fluid container 9*a*' is connected to a discharge opening of the spray gun 3*a* via a cleaning fluid changeover valve 16 disposed in the piping 14*d*. The cleaning fluid changeover valve 16 is connected to a cleaning fluid changeover circuit 3*a*-2 contained in the spray gun 3*a*. When a predetermined quantity of sliders 10 of a desired type have been coated, the coating changeover valves disposed inside the spray gun 3*a* close the corresponding pipes and, at the same time, the cleaning fluid changeover valve 16 is opened to clean the discharge opening and the interior of the spray gun 3*a*.

As an alternative coating changeover means of the coating portion 3 and an alternative cleaning means for the spray gun 3*a*, a changeover technique for continuous spray dying, such as disclosed in U.S. Pat. No. 5,081,731, may be used. Briefly describing, the disclosed changeover technique employs at least one pair of spray nozzles which can be changed over. One of the,spray nozzles is selected to spray a coating onto article to be dyed while the articles are running. During that time, the other spray nozzle is automatically cleaned and then connected to a supply system for a new dye to be sprayed in the subsequent spraying process. For a further description of the details of the changeover technique, reference may be made to the aforesaid U.S. Pat. No. 5,081,731.

The coating station 3 shown in the illustrated embodiment described above has only one spray gun 3*a*. Since in many cases only one coating stage cannot form a uniform coating film over the entire surface of a product (slider in the illustrated embodiment), two or more coating stages may be employed. In the latter case, the coating chamber of the coating station 3 is divided into three sub-chambers. Two of these sub-chambers which are located respectively at the upstream and downstream sides have a pair of coating means (spray guns) 3*a*, respectively, while an intermediate sub-chamber is preferably provided with a heating and ventilating means (not shown) for vaporizing a solvent in the coating sprayed at the preceding stage (in the upstream sub-chamber) and discharging the vaporized solvent, thereby preventing generation of air babbles which would otherwise occur at the subsequent coating stages due to vaporization of the remaining solvent. The intermediate sub-chamber is separated from the upstream and downstream sub-chambers by a pair of curtains formed from, for example, a rubber coated fabric.

In the illustrated embodiment, the coating station 3 is followed by a setting station 17 (FIG. 1) which is provided in order to avoid generation of air bubbles due to intense heating and baking in the subsequent drying and baking station 4. The setting station 17 includes a tunnel-like feed passage through which the coated products carried on the product conveying means 1 (coated sliders 11 on the metal tape 1 in the illustrated embodiment) move, and a blower (not designated) for forcing air through the tunnel-like feed passage to completely remove the solvent from the coating on the products.

Figure 8:
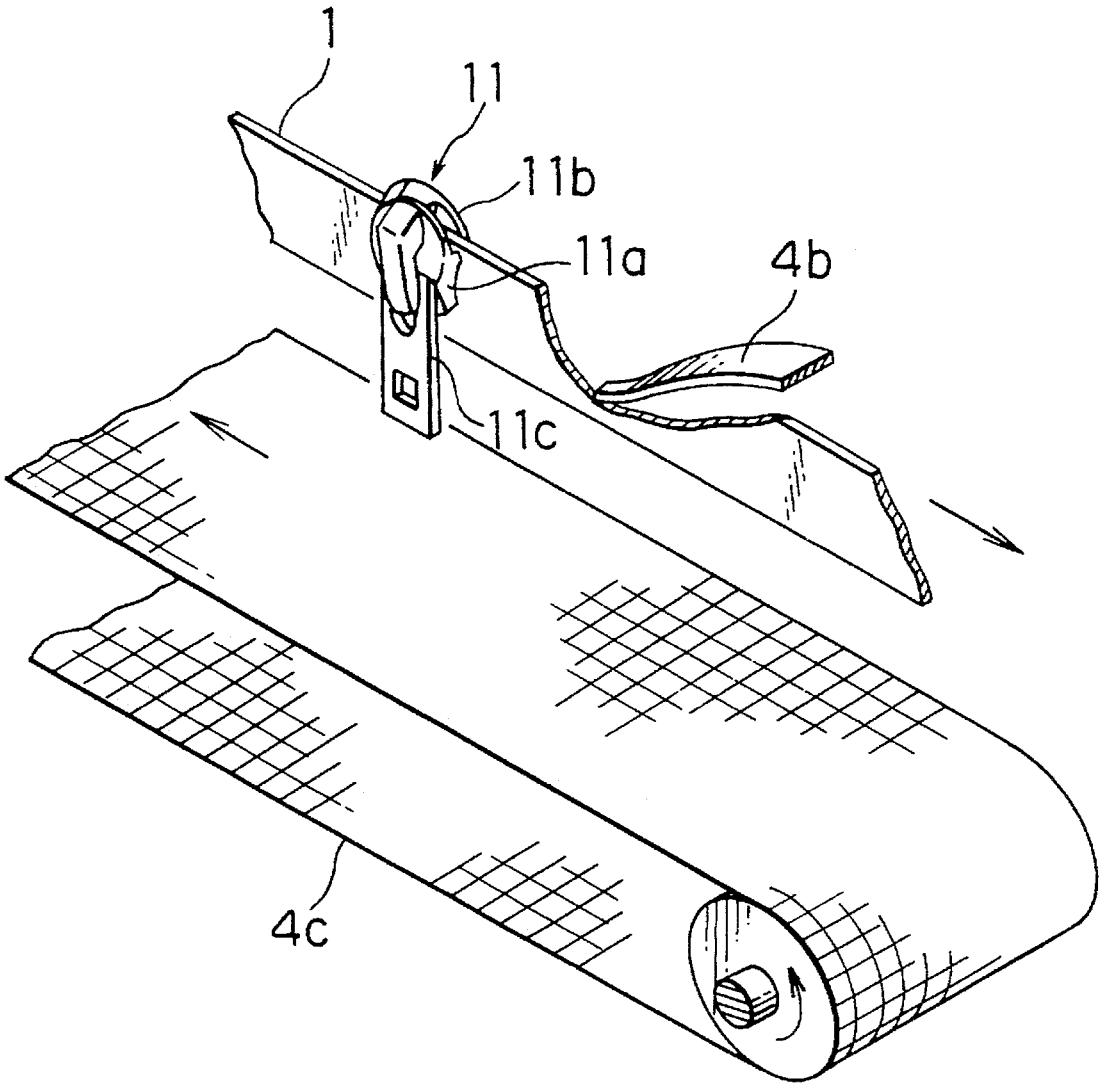
FIG. 8 is a perspective view, with parts cutaway for clarity, of an outlet portion of a drying and baking station, showing a traveling condition of an endless conveyor tape.
Figure 9:
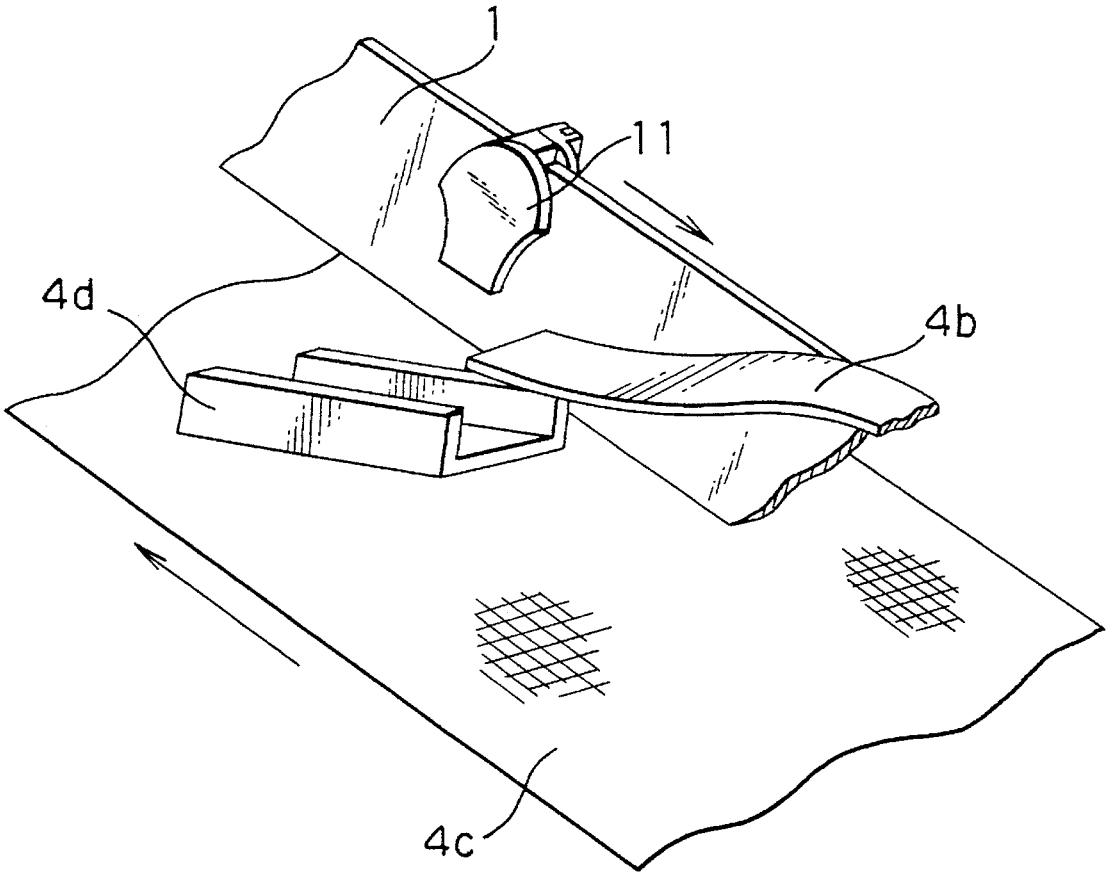
FIG. 9 is a view similar to FIG. 8 showing another example of the outlet portion of the drying and baking station.

FIG. 8 shows on enlarged scale a main portion of the drying and baking station 4. Likewise the coating chamber described above, the drying and baking station 4 is composed of a closed heating chamber having an inlet and an outlet for the passage therethrough of the metal tape 1. As shown in FIGS. 1, 8 and 9, the heating chamber 4 includes a product removing means 4*b* disposed adjacent to the outlet for removing the pre-dried coated sliders 11 from the metal tape 1 while the metal tape 1 is running through the heating chamber 4. The product removing means 4*b*, as shown in FIG. 8, is composed of a curved plate member located on one side of the upper edge of the metal tape 1 which is opposite to the pull tab 11*c* of the coated slider 11. As the metal tape 1 advances, a sloped surface of the curved plate member (product removing means) 4*b* engages a lower wing 11*b* of the slider 11, then guides the lower wing 11*b* upwardly to lift up the slider 11, and eventually removes the slider 11 from the metal tape 1. The product removing means 4*b* of the foregoing construction is construed as illustrative and not restrictive.

At least one stage of removed slider transfer means 4*c* is disposed horizontally in the heating chamber 4 and underlies substantially whole length of the metal tape 1 extending longitudinally across the length of the heating chamber 4. The removed slider tranfser means 4*c* in the illustrated embodiment is composed of an endless conveyor belt made of a wire mesh having a predetermined mesh size so that the coated sliders 11 are dried and baked by heat applied from the above and below the wire mesh conveyor belt 4*c* while the coated sliders 11 are conveyed by the wire mesh conveyor belt 4*c*. The drying and baking means 4*a* is composed of a infrared dryer or a hot air dryer. In order to protect the coated sliders 11 from damaging when the coated sliders 11 drop onto the conveyor belt 4*c*, an outer surface of the conveyor belt 4*c* may be coated with a thermally resistant flexible material. In addition, an inclined chute 4*d* extending between the product removing means 4*b* and the conveyor belt 4*c* as shown in FIG. 9 may be provided to substantially eliminate a shock force which would otherwise be produced when the sliders 11 on the metal tape 1 fall directly onto the conveyor belt 4*c*.

The conveyor belt 4*c* runs or rotates in a direction which is opposite to the direction of travel of the metal tape 1, as shown in FIGS. 1, 8 and 9. If two or more parallel vertically spaced conveyor belts (multistage conveyor belts) are used, a first conveyor belt disposed immediately below the metal tape 1 runs in a direction opposite to the direction of travel of the metal tape 1, as described above, and each of the second to the last conveyor belts runs in a direction opposite to the running direction of the preceding conveyor belt disposed immediately above. The coated product discharge means 4*e* comprised of a discharge chute (FIG. 1) is disposed at a downstream end of the conveyor belt 4*c* for discharging the bake-finished sliders 11 from the coating system.

The conveyor belt 4*c* thus provided insures that the coated sliders 11 while being conveyed within the heating chamber 4 can be heated for a sufficiently long period of time to ensure sufficient baking of the coating films on the sliders 11, and at the same time the overall length of the heating chamber 4 can be reduced. In addition, since the metal tape 1 passes through the heating chamber 4 in a short period of time, the coating adhering on the metal tape 1 is not completely bared but still wet. Accordingly, the wet coating can be readily removed from the metal tape 1 as the metal tape 1 moves through the coating removing station 5 which is composed of a coating removing chamber disposed immediately downstream of the heating chamber 4.

As shown in FIG. 1, a coated product transporting means 18 composed of a container box is disposed below the discharge chute 4*e* for receiving therein the bake-finished coated sliders 11. When a predetermined number of coated sliders 11 are received, the container box 18 is transferred, for example, to a slide fastener chain manufacturing machine which may be disposed downstream of the automatic slider coating machine of the present invention. The automatic slider coating machine may be directly connected to a slider attachment station of the slide fastener chain manufacturing machine in which instance the container box 18 used for transferring the coated sliders in lot may be replaced with a parts feeder. In the latter case, all of the necessary steps of operation of the automatic slider coating machine and the slide fastener chain manufacturing machine are automatically carried out in accordance with a production control procedure stored in a control unit.

Figure 10:
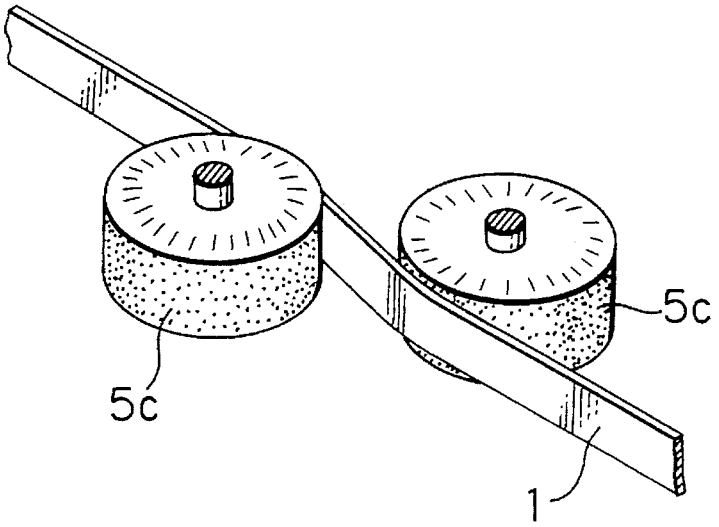
FIG. 10 is a fragmentary perspective view showing an example of coating removing mechanism for removing a coating from opposite surfaces of the endless conveyor tape according to the present invention.

FIG. 10 shows a coating removing mechanism used in the coating removing station 5 for removing the coating from the metal tape 1. As shown in FIG. 1, the coating removing station 5 is composed of a closed chamber and includes an electric motor 5*a* and two rotating shafts 5*b* connected in driven relation to the electric motor 5*a* via a suitable power transmission mechanism. Two rotary brushes 5*c* are secured to free ends of the rotating shafts 5*b* for brushing off the coating from opposite surfaces of the metal tape 1. The coating removing mechanism described above is extremely simple but is readily able to remove the coating from the metal tape 1 because the metal tape 1 passes through the heating chamber 4 during a short period of time and hence the coating on the metal tape is not completely baked but still wet. The metal tape 1 with its opposite surfaces free from coating continues its running and returns to the uncoated-slider supplying station 2.

The automatic slider coating machine of the foregoing construction operates as follows. According to a production procedure stored in the control unit 6, uncoated sliders of a particular type are supplied one after another at regular intervals from the supplying station 2 onto an upper edge of the metal tape 1 running in one diction along an endless traveling path. The uncoated sliders 10 supplied to the metal tape 1 are then introduced into the coating station 3. In the coating station 3, an electrostatic spray coating process is achieved to provide a coating uniformly over the entire surface of each slider 10. The coating station 3 is followed by the setting station 17 in which a solvent is vaporized to set the coating on the surface of the slider 10 and the surface of the metal tape 1. Coated sliders 11 which have passed through the setting station 17 subsequently move into the drying and baking station 4 held in a closed condition.

In the drying and baking station 4, as the metal tape 1 passes through the drying and baking station 4, the coated sliders 11 carried on the metal tape 1 are pre-dried and then removed from the metal tape 1 by the slider removing means 4*b* disposed adjacent to the outlet of the drying and baking station 4. The removed coated sliders 11 fall by gravity down onto the endless conveyor belt 4*c* which is running below the metal tape 1 in a direction opposite to the direction of travel of the metal tape 1. The sliders 11 dropped onto the conveyor belt 4*c* are conveyed in the reverse direction within the drying and baking station 4 during which time a sprayed coating on the surface of each slider 11 is baked to form a tough, durable coating film. By virtue of the conveyor belt 4*c* which is provided as a first one of a multiplicity of vertically arranged baking stages, a sufficient baking time can be secured even when the drying and baking station 4 is half the length of a conventional drying and baking station. The drying and baking process can be achieved efficiently when the conveyor belt 4*c* in the drying and baking station 4 is made of a wire mesh having a predetermined mesh size.

The bake-finished sliders 11 are collected via the discharge chute 4*e* into the container box which constitutes the coated product transporting means 18 and then transferred to the next processing step by a suitable conveying means.

On the other hand, after removal of the coated sliders 11, the metal tape 1 continues its forward motion in one direction and enters the coating removing station 5 where the coating adhering to the front and back surfaces of the metal tape 1 is removed by the coating removing means such as a pair of rotating brushes. In this instance, since the metal tape 1 has passed through the drying and baking station 4 in a short period of time which is not exceeding one half of the usual drying and baking time, the coating on the metal tape 1 has not been baked completely but can be readily removed by brushing achieved, for example, by a simple mechanical removing means such as rotary brushes.

When a predetermined quantity of the sliders of the particular type have been coated, the foregoing coating operation is completed. Then, according to data stored in the control unit 6, such as a type and a quantity of sliders to be coated next and coatings to be used next, the control unit 6 issues instructions to activate the slider arresting device 2*a* and the slider changeover device 2*b* of the slider supply station 2 and changeover the necessary coating pipings in the coating station 3 while adjusting the spraying pressure of a predetermined coating.

More specifically, when the next coating operation is started, the stopper 2*a*-2 of the slider arresting device 2*a* is retracted from the slider guide channel in the guide rail 2*a*-1, thereby allowing the uniformly arranged uncoated sliders 10 to slide down by gravity along the guide rail 2*a*-1. The number of the sliders 10 thus sliding downwardly is detected by the detector 2*b*-1 of the slider changeover device 2*b* and when the number of the detected sliders is equal to a preset value, the fluid-pressure actuator 2*a*-3 is driven to project the stopper 2*a*-2 into the slider guide channel in the guide rail 2*a*-1, thereby arresting downward sliding movement of the subsequent sliders 10. At the same time, according to control signals sent at predetermined time intervals from the control unit 6, the delivery speed controlling device 2*b*-2 is intermittently driven to deliver the sliders 10 at predetermined intervals from the slider guide channel to the metal tape 1.

On the other hand, in the coating station 3, a coating container 9*a* holding therein a coating or paint of a different color to be used in the next coating operation is set in a predetermined position in the coating station 3 and connected to a corresponding force feed pump 13 before the slider supplying station 2 changes over the type of sliders to be supplied. When the preceding coating operation completes, a coating changeover valve contained in the spray gun 3*a* closes the coating piping used in the preceding coating operation, and the cleaning fluid changeover valve 16 is opened to clean up the interior of the spray gun 3*a* and the discharge opening of the spray gun 3*a*. When the spray gun 3*b* is completely cleaned up, a coating piping to be used in the next coating operation is opened and a new coating or paint is forced out by the force feed pump 13 and flows through the thus opened coating piping to spray gun 3*a*. During that time the discharge pressure of the coating is regulated. The pressure-regulated coating is finally sprayed from the spray gun 3*a* onto the sliders 10 carried on the upper edge of the metal tape 1 while the metal tape 1 is running through the coating station 3.

As is apparent from the foregoing description, when small quantities of products of various different types are coated on the automatic coating system of the present invention, a predetermined quantity of products of a desired type and a coating of a desired color are automatically selected and fed to a coating station. With this automatic feeding of the necessary materials, all the products of different types can be mechanically and fully automatically coated with the result that the delivery time limit can be cut down and the overall size of the coating system can be reduced by virtue of an extremely reasonable design. When an endless metal tape is used for conveying the products to be coated, the posture of the metal tape while running is automatically rectified depending on the position of the center of gravity of the products even if the products have a complicated configuration. Thus, the products can be coated uniformly throughout the surface thereof. Particularly in the case where a coated product removing means is disposed in the heating chamber adjacent an outlet thereof, and at least one stage of coated product conveying means running in a direction opposite to the direction of travel of the metal tape is disposed below the metal tape within a heating chamber, even when the metal tape passes through the heating chamber by one time, a sufficient baking time to bake the coated products within the heating chamber can be maintained. Even when the heating chamber is reduced in length, a coating on the coated products can be baked completely. Thus, a substantial space saving is possible. In addition, since the metal tape passes through the heating chamber by only one time, opposite surfaces of the metal tape can be readily cleaned up by a simple coating removing mechanism, such as a pair of cleaning brushes, disposed in a coating removing chamber which is disposed immediately downstream of the drying and baking chamber.

Obviously, various minor changes and modifications of the present invention are possible in the light of the above teaching. It is therefore to be understood that within the scope of the appended claims the invention may be practiced otherwise than as specifically described.

What is claimed is:

1. An automatic coating system for coating quantities of different products comprising:

at least one endless, product conveying means running in one direction along an endless traveling path;

a product supplying station disposed adjacent to a portion of said traveling path for supplying uncoated products to said product conveying means;

a coating station disposed in said traveling path downstream of said product supplying station for coating the uncoated products;

a drying and baking station disposed in said traveling path downstream of said coating station and including drying and baking means for drying and baking coated products, and coated product discharging means for discharging the coated products from the drying and baking station;

a coating removing station disposed in said traveling path downstream of said drying and baking station for removing a coating from said product conveying means;

a control unit for controlling the operation and timing of said conveying means, said product supplying station, said coating station, said drying and baking station, and said coating removing station;

automatic product selecting means for selecting out a predetermined quantity of uncoated products according to a production control procedure stored in said control unit;

automatic mixing and thinning apparatus connected with said coating station for selecting out at least one coating of a predetermined color from among a multiplicity of base coatings of different colors, and automatically weighing, mixing, and optionally thinning the selected coating according to the production control procedure stored in said control unit;

said product supplying station including automatic supplying means operatively connected with said automatic product selecting means for supplying the predetermined quantity of uncoated products to said product conveying means while successively aligning the uncoated products; and said coating station being composed of a closed coating chamber and including coating means for coating the uncoated products with said selected coating, and further including mist removing means for removing a mist from said closed coating chamber.

2. An automatic coating system according to claim 1, wherein said drying and baking station is composed of a closed heating chamber having an inlet and an outlet for the passage therethrough of said product conveying means and includes product removing means disposed adjacent to said outlet for removing coated products from said product conveying means while said product conveying means is running, and at least one stage of removed product transfer means for receiving the coated products removed from said product conveying means and thereafter conveying the thus received coated products in the opposite direction.

3. An automatic coating system according to claim 1, wherein said product conveying means comprises an endless metal tape.

4. An automatic coating system according to claim 1, wherein the number of said coating means is at least one and said at least one coating means includes a coating changeover circuit and a cleaning fluid changeover circuit.

5. An automatic coating system according to claim 2, wherein said removed product transfer means further comprises a porous endless belt.

6. An automatic coating system according to claim 2, further including an inclined chute extending between said product removing means and said removed product transfer means.

* * * * *